US005092776A

United States Patent [19]

Shanahan

[11] Patent Number: 5,092,776

[45] Date of Patent: Mar. 3, 1992

[54] CHILD'S EDUCATIONAL MONETARY GAME APPARATUS

[76] Inventor: Ann M. Shanahan, 13 Offspring Ct., Perry Hall, Md. 21128

[21] Appl. No.: 559,677

[22] Filed: Jul. 23, 1990

[51] Int. Cl.[5] ..... A63H 33/00

[52] U.S. Cl. ..... 434/128; 446/8; 446/73

[58] Field of Search ..... 434/100, 195, 79, 208, 434/403, 429; 446/8, 73, 76

[56] References Cited

U.S. PATENT DOCUMENTS

| | | | |
|---|---|---|---|
| 2,020,176 | 11/1935 | Fleischer | 446/8 X |
| 2,398,011 | 4/1946 | Kaplan | 446/8 X |
| 2,510,884 | 6/1950 | Greene | 446/8 |

*Primary Examiner*—Richard J. Apley
*Assistant Examiner*—Glenn E. Richman
*Attorney, Agent, or Firm*—Leon Gilden

[57] ABSTRACT

An apparatus including a unitary structure defined by a first, second and third dwelling container, each of ascending sizes, with each respective dwelling container defined by respective first, second, and third contrastingly patterned or colored receptacle. Each of the dwelling containers includes a plurality of variously patterned or colored plate members of a like pattern coloration as to that of an associated dwelling container, with each dwelling container demarcating an increasing monetary value associated with each plate member. The dwelling containers may further include a removable tray receivable within a cavity directed through an upper end of each dwelling container for storage and securement of the plate members therewithin. Positioning of the various plate members within each of the associated receptacles of each of the respective dwelling containers permits visual reinforcing to a child of the various monetary value association of the plate members for indication of arbitrary monetary values.

6 Claims, 4 Drawing Sheets

CHILD'S EDUCATIONAL MONETARY GAME APPARATUS

BACKGROUND OF THE INVENTION

1. Field of the Invention

The field of invention relates to educational devices, and more particularly pertains to a new and improved child's educational monetary game apparatus wherein the same provides visual reinforcement and understanding to an individual such as a child of monetary values in association with a physical structure of a relative size commensurate with an associated monetary value denomination.

2. Description of the Prior Art

Various educational devices have been utilized in the prior art for the teaching and instruction of values to individuals. Frequently game organizations are utilized in providing entertainment, as well as educational understanding of various monetary values. For example, U.S. Pat. No. 4,521,197 to Lumpkins sets forth a game apparatus utilizing a series of cubicle members, wherein a plurality of the cubicle members include indicia corresponding with various monetary values, with a third cubicle member associated with direction for accumulating score based on the first and second cubicle members.

U.S. Pat. No. 4,571,189 to Shank provides a board layered with images of coins for use in association with overlays relative to the board, with the supervision of an instructor directing an individual to position combinations of overlays on the board to effect relationship between coins and bills of different denominations.

U.S. Pat. No. 4,501,425 to Alvarado provides a game organization utilizing rewards and penalties in association with investments, compensation, and the like directing players about the board game.

U.S. Pat. No. 4,629,195 to Charney provides a travel game utilizing coupons and monetary values for permitting traverse of the board by various players.

U.S. Pat. No. 4,775,321 to Comeaux, et al. sets forth a system for teaching various monetary values including a plurality of envelopes arranged in ascending order of monetary values to direct a student to work progressively through the system of envelopes to direct a student to ascertain a monetary value associated with each of the envelopes.

As such, it may be appreciated that there continues to be a need for a new and improved child's educational monetary game apparatus wherein the same addresses both the problems of ease of use as well as effectiveness in construction in reinforcing and enhancing a child's understanding of various monetary values and their relationships.

SUMMARY OF THE INVENTION

In view of the foregoing disadvantages inherent in the known types of educational monetary games now present in the prior art, the present invention provides a child's educational monetary game apparatus wherein the same utilizes physical size distinctions in association with monetary value distinctions in a like order of ascension to reinforce a child's understanding of monetary values. As such, the general purpose of the present invention, which will be described subsequently in greater detail, is to provide a new and improved child's educational monetary game apparatus which has all the advantages of the prior art educational monetary games and none of the disadvantages.

To attain this, the present invention provides an apparatus including a unitary structure defined by a first, second and third dwelling container, each of ascending sizes, with each respective dwelling container defined by respective first, second, and third contrastingly patterned or colored receptacle. Each of the dwelling containers includes a plurality of variously patterned or colored plate members of a like pattern coloration as to that of an associated dwelling container, with each dwelling container demarcating an increasing monetary value associated with each plate member. The dwelling containers may further include a removable tray receivable within a cavity directed through an upper end of each dwelling container for storage and securment of the plate members therewithin. Positioning of the various plate members within each of the associated receptacles of each of the respective dwelling containers permits visual reinforcing to a child of the various monetary value association of the plate members for indication of arbitrary monetary values.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the Public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved child's educational monetary game apparatus which has all the advantages of the prior art educational monetary games and none of the disadvantages.

It is another object of the present invention to provide a new and improved child's educational monetary game apparatus which may be easily and efficiently manufactured and marketed.

It is a further object of the present invention to provide a new and improved child's educational monetary game apparatus which is of a durable and reliable construction.

An even further object of the present invention is to provide a new and improved child's educational monetary game apparatus which is susceptible of a low cost of manufacture with regard to both materials and labor, and which accordingly is then susceptible of low prices of sale to the consuming public, thereby making such child's educational monetary game apparatus economically available to the buying public.

Still yet another object of the present invention is to provide a new and improved child's educational monetary game apparatus which provides in the apparatuses and methods of the prior art some of the advantages thereof, while simultaneously overcoming some of the disadvantages normally associated therewith.

Still another object of the present invention is to provide a new and improved child's educational monetary game apparatus wherein the same directs a child to understand various monetary values in association with physical size distinctions in association with the monetary values for reinforcement of relative monetary value understanding.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
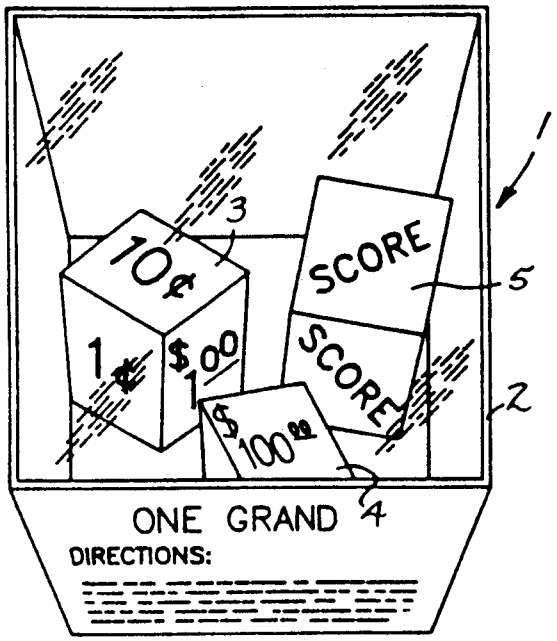
FIG. 1 PRIOR ART
FIG. 1 is an isometric illustration of a prior art monetary game organization.

With reference now to the drawings, and in particular to FIGS. 1 to 8 thereof, a new and improved child's educational monetary game apparatus embodying the principles and concepts of the present invention and generally designated by the reference numerals 10 and 10*a* will be described.

Figure 2:
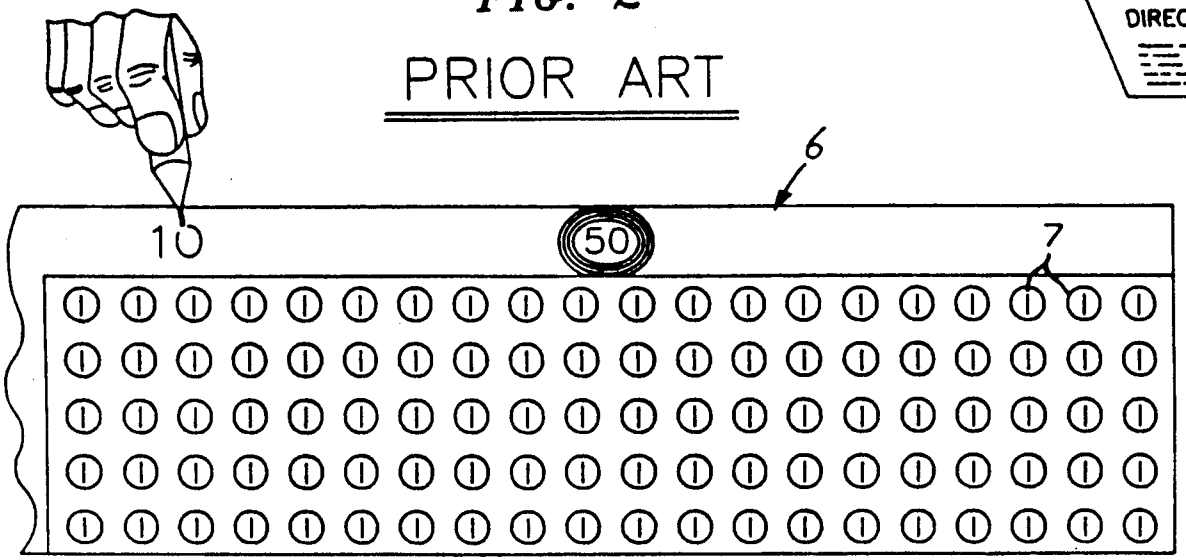
FIG. 2 PRIOR ART
FIG. 2 is an orthographic top view of a monetary game structure.
Figure 3:
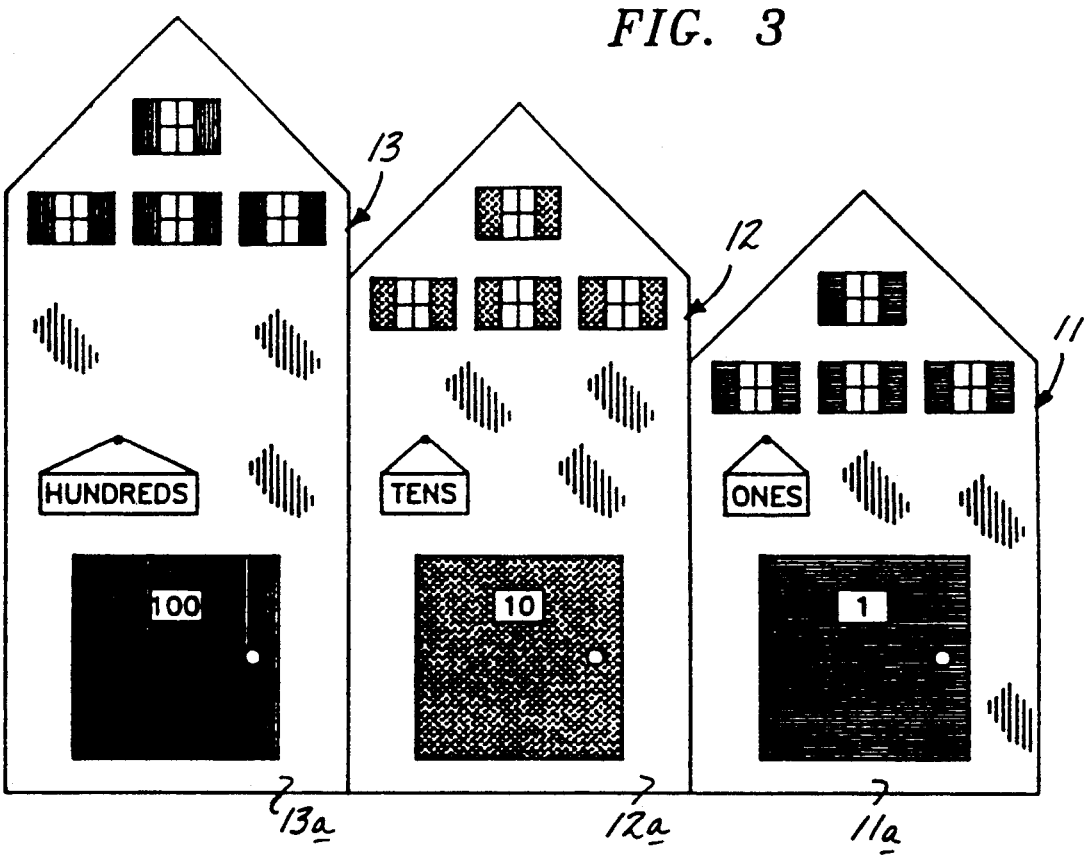
FIG. 3 is an orthographic front view, taken in elevation, of the instant invention.
Figure 4:
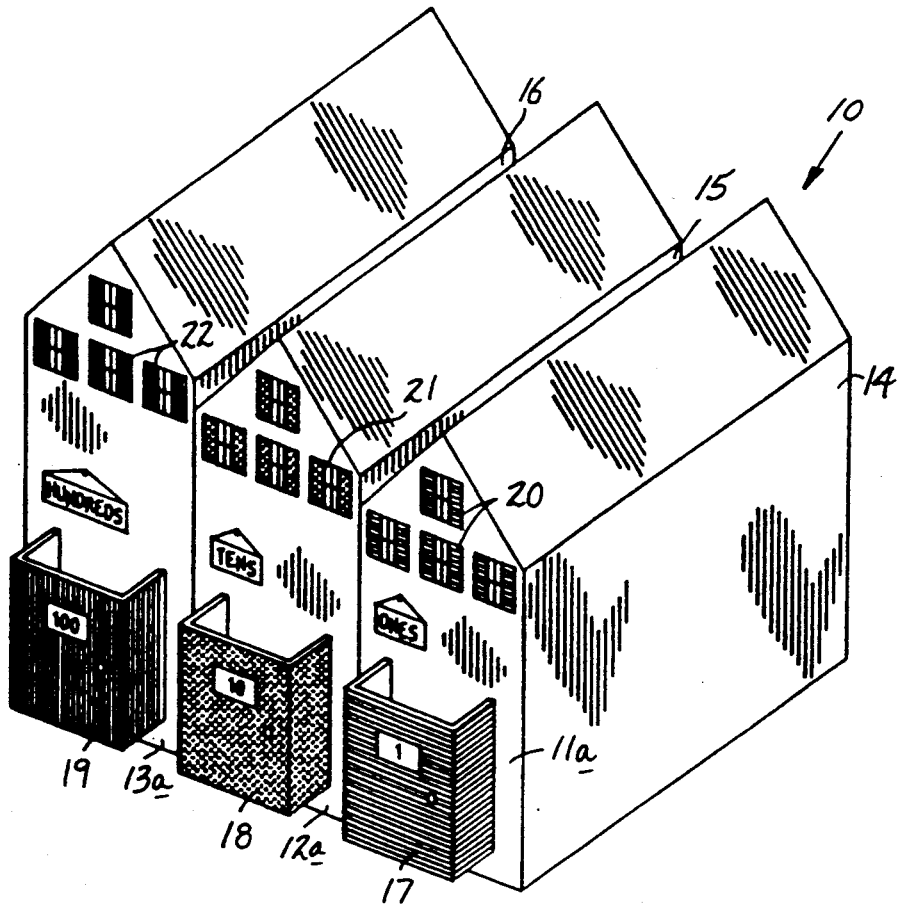
FIG. 4 is an isometric illustration of the instant invention.

FIG. 1 illustrates a prior art monetary game organization 1, wherein a housing container 2 includes a series of directions mounted and imprinted on a forward face thereof, wherein the container includes a respective first and second cube 3 and 4 respectively in association with coin and monetary note indicia imposed upon each face of the cube, with a third cube 5 indicating instructions upon directing the cubes into the container 2. FIG. 2 illustrates a prior art monetary game structure 6, wherein the board, as illustrated, utilizes a series and matrix of denominations, with the board arranged for receipt of various overlays (not shown) to associate the overlays on the board to establish relationships between different coin combinations, as well as relationships between coins and bills of different denominations, as set forth in U.S. Pat. No. 4,571,189.

More specifically, the child's educational monetary game apparatus 10 of the instant invention essentially comprises a series of integrally secured and longitudinally parallel dwelling containers, defined by a first, second, and third dwelling container 11, 12, and 13 respectively, each of an equal predetermined length. Each of the respective dwelling containers includes a respective first, second, and third right side wall 14, 15, and 16, with a left side wall of the first dwelling container 11 fixedly secured to and integrally mounted to the second right side wall 15, with a left side wall of the second dwelling container 12 fixedly mounted to and coextensive with the third right side wall 16. Each of the respective dwelling containers includes a respective first, second, and third front wall 11*a*, 12*a*, and 13*a*, with a parallel and respective first, second, and third rear wall 11*b*, 12*b*, and 13*b* (see FIG. 7). The front and rear walls are defined by respective first, second, and third front wall height of the respective first, second, and third dwelling containers, with the side walls defined by a first, second, and third side wall height for the respective first, second, and third side walls of the respective first, second, and third dwelling containers. The first dwelling container 11 includes a first receptacle 17 defined by a predetermined receptacle height of a first coloration or pattern. A second receptacle 18 is mounted to the second front wall 12*a* and is defined by the predetermined receptacle height of a second coloration or pattern in contrast to the first coloration or pattern 17. A third receptacle 19 of a third coloration or pattern of the same predetermined receptacle height is mounted to the front wall 13*b*. The respective first, second, and third dwelling containers 11, 12, and 13 are also provided with visual enhancements in the configurations of windows defined by first, second, and third windows 20, 21, and 22 of the same respective first, second, and third colorations of the associated first, second, and third dwellings to enhance visual association of the respective patterns of the respective dwelling containers. As illustrated, the dwelling containers are of ascending height and are accordingly associated with ascending values of monetary denominations, with the first dwelling container defined by the units of "ones", the second dwelling container 12 defined by the denominations of "tens", and the third dwelling container 13 defined by the denomination of "hundreds".

Figure 5:
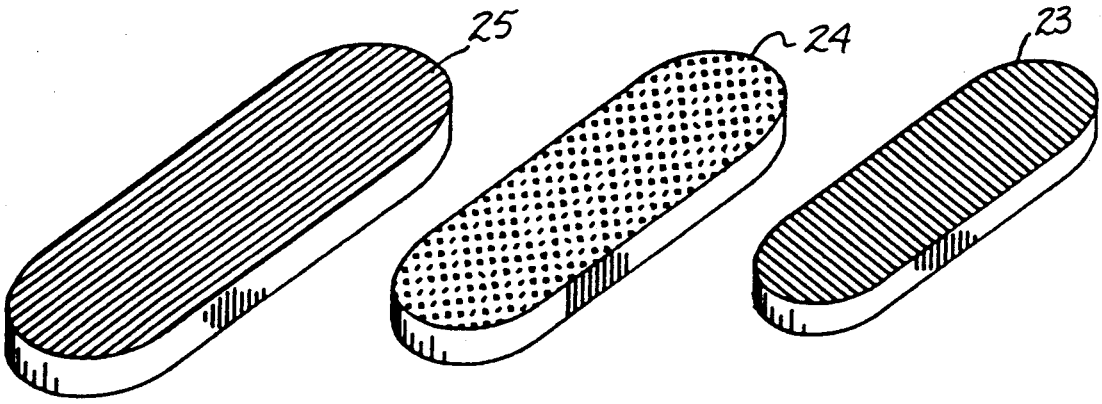
FIG. 5 is an isometric illustration of the plate member markers utilized by the instant invention.
Figure 6:
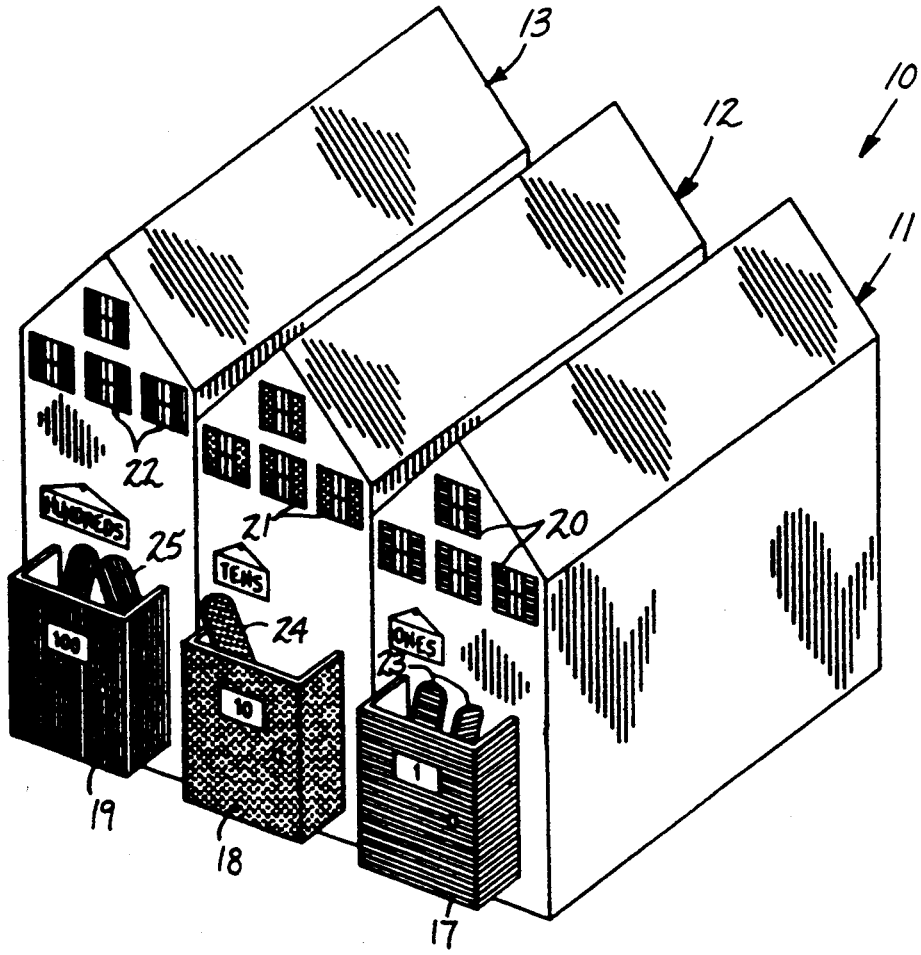
FIG. 6 is an isometric illustration of the plate member marker as utilized in association with the organization.

FIG. 5 illustrates the use of respective first, second, and third elongate plate markers 23, 24, and 25, each defined by the respective first, second, and third colorations in association with respective first, second, and third dwellings 11, 12, and 13 for use by a student or child to permit relative association of each marker with each dwelling for positioning within each respective receptacle. For example, a student to illustrate two hundred twelve dollars would direct two of the third markers 25 within the third receptacle 19, one second marker 24 within the second receptacle 18, and two first markers 23 within the first receptacle 17 to enhance a student or child to delineate between the various denominations by both pattern or coloration and physical size, as illustrated in FIG. 6 for example.

Figure 7:
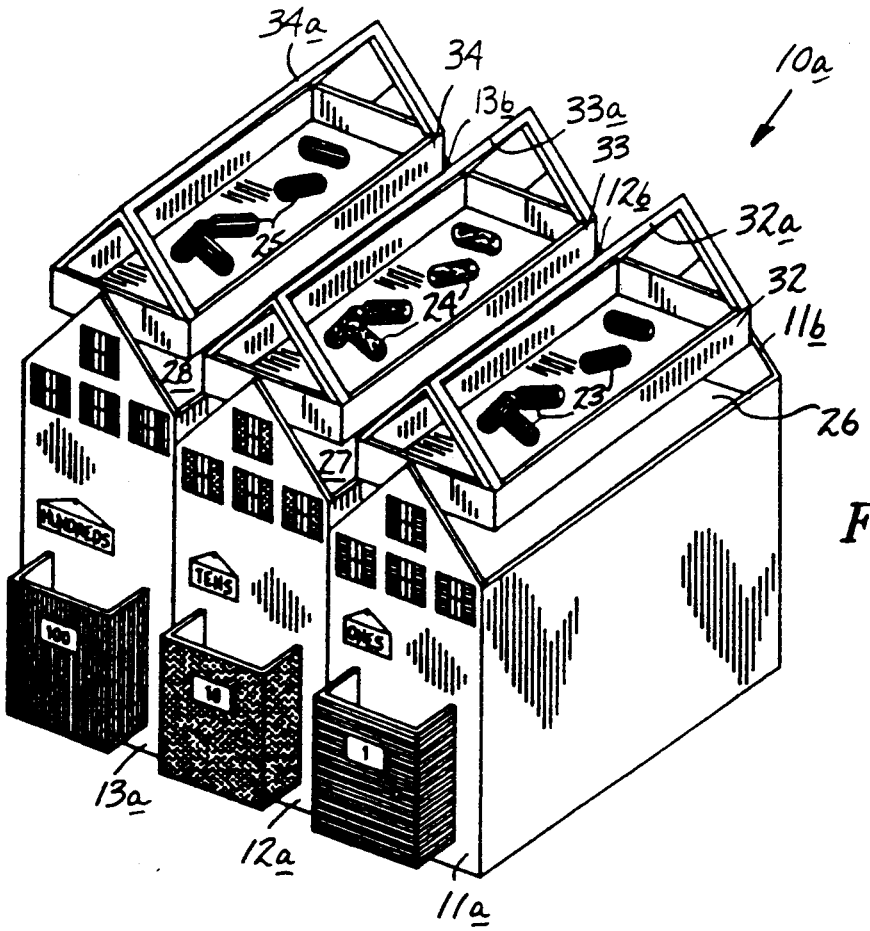
FIG. 7 is an isometric illustration of a modification of the instant invention.
Figure 8:
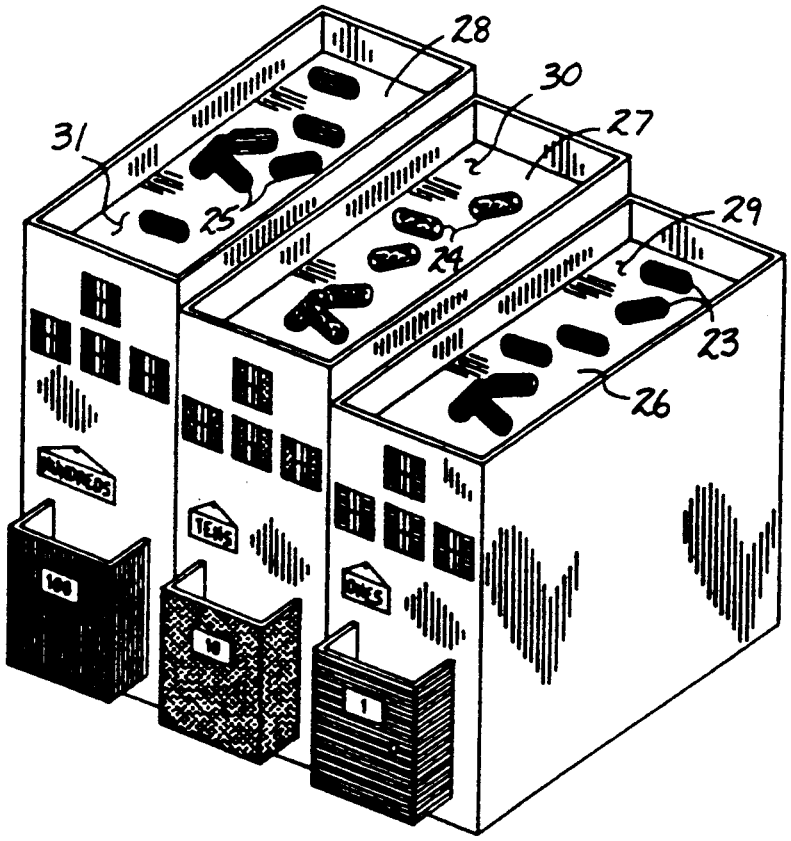
FIG. 8 is an isometric illustration of the invention as set forth in FIG. 7 with the trays removed therefrom.

FIG. 7 illustrates the use of a modified first, second, and third dwelling of relatively equal proportional configuration as to that as described above, but wherein each dwelling includes a respective first, second, and third floor 26, 27, and 28 positioned adjacent an upper end of each dwelling container, with each floor arranged orthogonally relative to the wall structure of each dwelling container. Each respective floor defines a respective first, second, and third cavity 29, 30, and 31 to receive a respective first, second, and third tray 32, 33, and 34 to provide storage for the respective markers of each of the respective dwelling containers, with each respective tray formed with a respective elongate longitudinally aligned handle 32*a*, 33*a*, and 34*a*. Each tray is defined by side wall structure to define a respective tray cavity substantially equal to each respective cavity of each associated dwelling container. The tray structure permits convenient manipulation and storage of a supply of markers for use during the training exercise, in a manner as outlined above.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A child's educational monetary game apparatus comprising, a first container integrally mounted to a second container, wherein the second container is integrally mounted to a third container, the first container including a first right side wall and a first left side wall, the second container including a second left side wall and a second right side wall the third container including a third right side wall and a third left side wall, each side wall of an equal predetermined length, the first left side wall integrally and coextensively mounted to the second right side wall, wherein the first side walls are defined by a first height, the second side walls are defined by a second height greater than the first height, and the third side walls are defined by a third height greater than the second height, and the first container is defined by a unitary monetary value, the second container is defined by a second monetary value, wherein the second monetary value is equal to ten times the unitary value, and the third container is defined by a third monetary value equal to ten times the second monetary value, and the second left side wall integrally and coextensively mounted to the third right side wall, and the first container including a first right wall, the second container including a second front wall, the third container including a third front wall, the first front wall including a first receptacle mounted thereon, the second front wall including a second receptacle mounted thereon, and the third front wall including a third receptacle mounted thereon, each receptacle of an equal receptacle height, and a first plurality of plate markers, a second plurality of plate markers, and a third plurality of plate markers, wherein the first, second, and third plate markers are removably mounted to each respective first, second, and third container.

2. An apparatus as set forth in claim 1 wherein the first receptacle is defined by a first coloration, the second receptacle is defined by a second coloration, and the third receptacle is defined by a third coloration, wherein the first markers are defined by the first coloration, the second markers are defined by the second coloration, and the third marker is defined by the third coloration.

3. An apparatus as set forth in claim 1 wherein the respective first, second, and third markers are receivable within respective first, second, and third receptacles for indication of respective monetary values for each respective container.

4. An apparatus as set forth in claim 3 wherein the first container includes a first floor, the second container includes a second floor, and the third container includes a third floor, wherein each floor is positioned adjacent an upper terminal end of each respective container and defines a respective first, second, and third cavity within an upper terminal end of each container.

5. An apparatus as set forth in claim 4 wherein the first cavity complementarily receives a first tray, the second cavity complementarily receives a second tray, and the third cavity complementarily receives a third tray, wherein the first, second, and third trays are selectively receivable and removable from the respective first, second, and third cavities.

6. An apparatus as set forth in claim 5 wherein the first, second, and third respective tray includes a respective first, second, and third handle coextensive with each tray to permit manual grasping of each tray for removal of each tray from each respective cavity.

* * * * *